United States Patent [19]

Aoyagi et al.

[11] Patent Number: 4,963,891

[45] Date of Patent: Oct. 16, 1990

[54] PLANAR ANTENNA

[75] Inventors: Yoshiki Aoyagi, Yokohama; Atsushi Murakami, Fujisawa; Mamoru Nakada, Machida; Mitsunori Ajiki; Shigeru Suzuki, both of Fujieda, all of Japan

[73] Assignee: Mitsubishi Kasei Corporation, Tokyo, Japan

[21] Appl. No.: 332,890

[22] Filed: Sep. 29, 1987

[30] Foreign Application Priority Data

Sep. 30, 1986 [JP] Japan ..... 61-233010

[51] Int. Cl.[5] ..... H01Q 1/38; H01Q 13/08

[52] U.S. Cl. ..... 343/700 MS; 428/901

[58] Field of Search ..... 343/700; 428/901

[56] References Cited

U.S. PATENT DOCUMENTS

| | | | |
|---|---|---|---|
| 4,728,962 | 3/1988 | Kitsuda et al. | 343/872 |
| 4,763,133 | 8/1988 | Takemura et al. | 343/912 |
| 4,772,496 | 9/1988 | Maeda et al. | 428/35 |

FOREIGN PATENT DOCUMENTS

| | | | |
|---|---|---|---|
| 149394 | 7/1985 | European Pat. Off. . | |
| 164420 | 12/1985 | European Pat. Off. . | |
| 0128611 | 6/1986 | Japan . | |
| 0029301 | 2/1987 | Japan . | |
| 0144405 | 6/1987 | Japan . | |
| 0157403 | 7/1987 | Japan . | |
| 2131232 | 6/1984 | United Kingdom | 343/700 |
| 2194101 | 2/1988 | United Kingdom . | |

OTHER PUBLICATIONS

Patent Abstracts of Japan, vol. 10, No. 91, 9 Apr. 1986, (E-394)(2148); and JP-A-60 235 505 (Showa Denko) 22-11-1985.

*Primary Examiner*—Rolf Hille
*Assistant Examiner*—Peter Toby Brown
*Attorney, Agent, or Firm*—Oblon, Spivak, McClelland, Maier & Neustadt

[57] ABSTRACT

A planar antenna comprising a dielectric layer containing a homopolymer of 3-methylbutene-1 or a copolymer of 3-methylbutene-1 and an alpha-olefin of from 2 to 12 carbon atoms, a polyene or a mixture thereof, a conductor laminated on the whole back surface of said dielectric layer and a circularly polarized radiation microstrip element formed from a metal foil and provided on the other surface of said dielectric layer.

15 Claims, 1 Drawing Sheet

PLANAR ANTENNA

BACKGROUND OF THE INVENTION:

The present invention relates to a planar antenna which is extremely small in dielectric loss and conductive loss. More in detail, the present invention relates to a planar antenna which comprises a dielectric layer containing a homopolymer of 3-methylbutene-1 or a copolymer of 3-methyl-butene-1 and an alpha-olefin of from 2 to 12 carbon atoms and/or a polyene, a conductor laminated on the back surface of the dielectric layer, and a circularly polarized radiation microstrip element formed from a metal foil and provided on another surface of the dielectric layer, and to a method for producing a planar antenna, which method comprises the steps of interposing a dielectric layer containing a homopolymer of 3-methylbutene-1 or a copolymer of 3-methylbutene-1 and an alpha-olefin of from 2 to 12 carbon atoms and/or a polyene between a conductor and a metal foil, molding the thus formed laminate by thermal pressing at a temperature of from 280° to 330 ° C. under a pressure of from 40 to 50 kg/cm$^2$, and etching the metal foil on the surface of the dielectric substrate, thereby forming a microstrip element circuit.

The planar antenna has been developed for receiving satellite broadcasting wave and has a merit of not being substantially influenced by snow, wind pressure, etc. as compared to the parabola antenna. However, at present, there is a problem in the planar antenna in that the gain is little.

Hitherto, for the dielectric substrate for the planar antenna, a fluorocarbon resin, glass fibers and a cross-linked polyethylene have been used as the dielectric substrate. However, from the viewpoint of the high price and the large dielectric loss of the materials, the improvement thereof has been necessitated.

On the other hand, connectors, printed circuit board, metal-plated plastics used for magnetic recording material, and durable composite material such as packaging material and bottles containing 3-methylbutene-1 have been known. For instance, a molded article produced by providing a thin metal layer on a homopolymer of 3-methylbutene-1 or a copolymer of 3-methylbutene-1 and an alpha-olefin of from 2 to 12 carbon atoms and/or a polyene [refer to Japanese Patent Application Laid-Open (KOKAI) No. 60-116764 (1985)]and a laminate produced by providing a thermoplastic resin layer or a metal layer on at least one of the surfaces of a sheet-form material made of a homopolymer of 3-methylbytene-1 or a copolymer of 3-methylbutene-1 and another alpha-olefin and/or a polyene [refer to Japanese Patent Application Laid-Open (KOKAI) No. 61-69452 (1986)]may be mentioned.

The present inventors have found that the high-frequency characteristics which have not been obtained by the conventional dielectric substrate for the planar antenna can be obtained by the use of a resin composed of a homopolymer of 3-methylbutene-1 or a copolymer of 3-methylbutene-1 and an alpha-olefin of from 2 to 12 carbon atoms and/or a polyene as the dielectric layer, and based on the finding, the present invention has been attained.

SUMMARY OF THE INVENTION:

In a first aspect of the present invention, there is provided a planar antenna comprising a dielectric layer containing a homopolymer of 3-methylbutene-1 or a copolymer of 3-methylbutene-1 and an alpha-olefin of from 2 to 12 carbon atoms, a polyene or a mixture thereof, a conductor laminated on the whole back surface of the dielectric layer and a circularly polarized radiation microstrip element formed from a metal foil and provided on the other surface of the dielectric layer.

In a second aspect of the present invention, there is provided a method for producing a planar antenna, which method comprises the steps of interposing a dielectric layer containing a homopolymer of 3-methylbutene-1 or a copolymer of 3-methylbutene-1 and an alpha-olefin of from 2 to 12 carbon atoms, a polyene or a mixture thereof between a conductor and a metal foil, molding the thus formed laminate by thermal pressing at a temperature of from 280 ° to 330 ° C. under a pressure of from 40 to 50 kg/cm2, and etching the metal foil on the surface of the dielectric substrate, thereby forming a microstrip element circuit.

Figure 1:
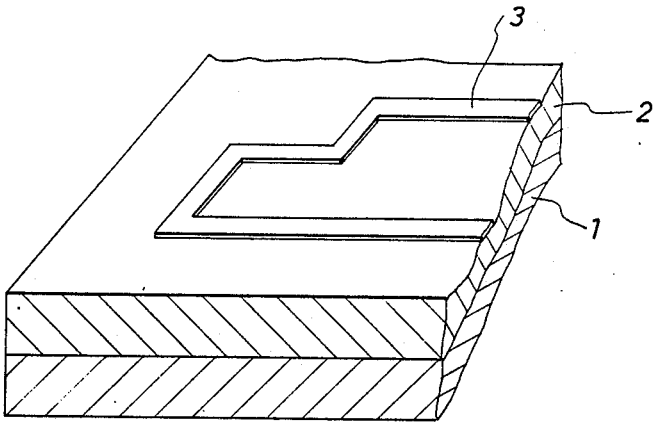
FIG. 1 shows an example of the planar antenna according to the present invention.

DETAILED DESCRIPTION OF THE INVENTION:

The gist of the present invention lies in the use of a dielectric layer containing a homopolymer of 3-methylbutene-1 or a copolymer of 3-methylbutene-1 and an alphaolefin of from 2 to 12 carbon atoms and/or a polyene as a dielectric layer in a planar antenna comprising the dielectric layer, a conductor laminated on the whole back surface of the dielectric layer and a circularly polarized radiation microstrip element formed from a metal foil and provided on the surface of the dielectric layer.

As the dielectric layer containing a homopolymer of 3-methylbutene-1 or a copolymer of 3-methylbutene-1 and an alpha-olefin of from 2 to 12 carbon atoms and/or a polyene, which is used in the present invention, a single or laminated substance comprising film or sheet of the polymer or copolymer of a thickness of from 20 to 1000 $\mu$m may be used.

Generally, the thickness of the dielectric layer is in the extent of from 500 to 1000 $\mu$m. In the case where the thickness is below 500 $\mu$m, the gain becomes smaller and on the other hand, in the case where the thickness is over 1000 $\mu$m, the effective area of the antenna becomes smaller. Namely, these two cases are unfavorable. The particularly preferable thickness of the dielectric layer is in the extent of from 750 to 850 $\mu$m.

Although a homopolymer of 3-methylbutene-1 gives the favorable dielectric characteristics to the planar antenna, it may be possible that the dielectric layer includes a copolymer of 3-methylbutene-1 of not less than 70% by weight, preferably not less than 80 % by weight and an alpha-olefin of from 2 to 12 carbon atoms and/or a polyene of not more than 30% by weight, preferably not more than 20 % by weight from the viewpoint of the moldability of the material.

The homopolymer of 3-methylbutene-1 shows a melting point of from 260 to 310° C, a dielectric constant ($\epsilon$) of from 2.0 to 2.2 and a dielectric loss tangent (tan $\delta$) of from $10\times10^{-4}$ to $12\times10^{-4}$ at a frequency of 12 GHz, namely the homopolymer of 3-methylbutene-1 is provided with excellent properties as the dielectric substance for the planar antenna.

However, in the case where the planar antenna is installed in a place under severe conditions, in order to improve the durability of the warp due to the temperature change, it is preferable to laminate a glass cloth of from 50 to 200 μm in thickness between the dielectric layer and the metal foil. In this case, a dielectric constant (ε) and a dielectric loss tangent (tan δ)of the thus laminated material are respectively not larger than 2.2 and not larger than $15\times10^{-4}$.

As the glass cloth, those made of alkali glass and those made of quartz glass may be exemplified, and from the viewpoint of electrical properties, those made of quartz glass are preferable.

Furthermore, in the case of making the dielectric layer porous for improving the durability and the dielectric properties, the dielectric constant (e) becomes to not higher than 2.0, preferably not higher than 1.7 and the dielectric loss tangent (tan 6) becomes to not higher than $7\times10^{-4}$, preferably not higher than 5 x 10 Namely, the specific properties of higher degree can be achieved, and it is particularly favorable.

According to the present invention, a copper-damage inhibitor, an anti-ultraviolet agent, an antioxidant, etc. may be added into the dielectric layer if necessary. On the other hand, a filler such as glass balloon,alumina fiber, alumina cloth, silica, mica, etc. may be added into the dielectric layer in the extent which does not damage the dielectric properties of the dielectric layer.

An example of the laminate construction of the planar antenna according to the present invention is briefly explained as follows.

FIG. 1 shows an example of the planar antenna according to the present invention, and in FIG. 1, 1 is a conductor, 2 is a dielectric layer of a polymer of 3-methyl- butene-1 and 3 is a microstrip element.

The conductor 1 is composed of a metal plate of aluminum, etc. and generally has a thickness of from 0.5 to 3.0 mm. The microstrip element (receiving circuit) 3 is generally formed by etching a metal foil of copper, etc. of from 10 to 40 μm in thickness.

The pattern of the circuit is designed for receiving the circularly polarized waves sent from the broadcasting satellite and in consideration of the receiving frequency band, etc.

The electric current generated by receiving the electric-wave flows in the microstrip element 3 and is sent to converter and tuner through the coaxial cable via the feed point (not shown in FIG. 1).

The dielectric substrate for the planar antenna, which has the above-mentioned construction, is produced as follows.

Between a conductor made of an aluminum plate of a thickness of from 0.5 to 3.0 mm and a copper foil of a thickness of from 10 to 40 μm, a sheet of the polymer of 3-methylbutene-1 of a thickness of from 500 to 1000 μm is interposed, and the thus formed laminate are molded into one body by an electrically heating press of a temperature of heat plate of from 280° to 330 ° C. and of a pressure of from 10 to 50 g/cm$^2$, thereby obtaining a dielectric substrate having the two metal-clad surfaces for the planar antenna.

It is preferable to make the surface of the aluminum plate coarse by anodic oxidation treatment, physical grinding treatment, etc. for improving the adherence of the aluminum plate to the polymer of 3-methylbutene-1.

Besides, as the copper foil, the electrolytic copper foil, the rolled copper foil and the oxygen-free copper foil can be used, however, from the viewpoint of the high frequency properties, the oxygen-free copper foil is preferable.

As the dielectric substance, in order to provide the strength and the durability, it is possible to laminate the afore-mentioned glass cloth, a film of fluorocarbon resin (Teflon ®, etc.), a composite material of a fluorocarbon resin and glass cloth, etc. in combination with the film or sheet of a polymer of 3-methylbutene-1 and to mold the thus formed laminate into one body by heating under a pressure.

In this case, in order to improve the adhesion between the films or the sheets of the polymer of 3-methyl-butene-1 and the fluorocarbon resin and further the adhesion between the film or the sheet of the polymer of 3-methyl-butene-1 and the metal foil or the glass cloth, it is preferable that the polymer of 3-methylbutene-1 is a modified polymer obtained by graft-polymerizing a radically polymerizable monomer to at least part of the polymer of 3-methyl-butene-1.

Further, as the monomer for the graft polymerization, various monomers such as an unsaturated carboxylic acid and the derivative thereof, for instance, a monocarboxylic acid such as acrylic acid, an ester derivative such as glycidyl acrylate, an unsaturated dicarboxylic acid and the anhydride thereof such as maleic acid and maleic anhydride, an amide such as maleamide, unsaturated carboxylic acids such as cycloaliphatic polyvalent carboxylic acids containing unsaturated bonds, an aromatic vinyl compound such as styrene and alpha-methylstyrene, a vinyl ester such as vinyl acetate, etc. may be used. It is possible to carry out the modification of the polymer of 3-methylbutene-1 by the use of a mixture of the above-mentioned monomers.

In the above-mentioned monomers, an unsaturated carboxylic acid and the derivative thereof, such as an unsaturated monocarboxylic acid, an ester derivative, an unsaturated dicarboxylic acid and the anhydride thereof is preferable.

The most preferable is an unsaturated dicarboxylic acid and the anhydride thereof.

The amount of graft polymerization may be generally in the extent of from 0.01 to 10% by weight per the grafted polymer of 3-methylbutene-1, however, according to circumstances, the grafted polymer having graft polymerization of up to 60% by weight may be used.

In the case of modifying by an unsaturated carboxylic acid, it is preferable that the amount of the unsaturated carboxylic acid is in the extent of from 0.02 to 1% by weight per the finally obtained composition.

Furthermore, it is preferable that the surface of the film or sheet of the polymer of 3-methylbutene-1 and fluorocarbon resin has been treated with corona discharge, etc.

In order to further improve the gain, it is preferable to make the polymer of 3-methylbutene-1 porous, and the extent of porosity is generally not smaller than 1.2 times, preferably from 1.5 to 5 times as calculated by expansion ratio.

For making the polymer porous, there are several methods as follows.

To make porous by adding a chemical foaming agent.

To make porous by injecting nitrogen gas or fluorocarbon gas.

To make porous by compounding a plasticizer and extracting the same.

To make porous by a sintering method.

However, in order to obtain a porous material having minute and uniform pores, the method of compounding a plasticizer with the polymer and extracting the thus compounded plasticizer is a preferable method.

As the plasticizer [Component (B)]which is compounded with the polymer of 3-methylbutene-1 [Component (A)], an aliphatic compound, an aromatic compound, an aliphatic mineral oil and an aromatic mineral oil is preferably used according to the under-mentioned reasons.

Namely, (1) the compatibility thereof with the substrative resin is favorable; (2) they are soluble in a easily handlable solvent such as a lower alcohol, a hydrocarbon or a mixture thereof and (3) they are excellent in thermal stability and the boiling point thereof is not lower than 260° C.

Concerning the Component (B), as the aliphatic compound, alcohols such as cetyl alcohol[$CH_3(CH_2)_{14}CH_2OH$], heptadecyl alcohol[$CH_3(CH_2)_{15}CH_2OH$], stearyl alcohol[$CH_3(CH_2)_{16}$-$CH_2OH$], ceryl alcohol[$CH_3(CH_2)_{24}CH_2OH$] and behenyl alcohol[[$CH_3(CH_2)_{20}CH_2OH$]; ethers such as dioctyl ether[$(C_8H_{17})_2O$], didecyl ether[$(C_{10}H_{21})_2O$], didodecyl ether[$(C_{12}H_{25})_2O$]and dioctadecyl ether[$C_{18}H_{37})_2O$]; ketones such as methyl tetradecyl ketone[$CH_3CO(CH_2)_{13}CH_3$], n-propyl hexadecyl ketone[$CH_3(CH_2)_2$-$CO(CH_2)_{15}CH_3$], didodecyl ketone[$CH_3(CH_2)_{11}CO(CH_2)_{11}CH_3$] and dioctadecyl ketone[$CH_3(CH_2)_{17}CO(CH_2)_{17}CH_3$]; esters such as octyl laurate[$CH_3(CH_2)_{10}COO(CH_2)_7CH_3$], ethyl palmitate[$CH_3(CH_2)_{14}COOCH_2CH_3$], butyl stearate[$CH_3(CH_2)_{16}$-$COO(CH_2)_3CH_3$] and octyl stearate[$CH_3(CH_3(Ch_2)_{16}COO(CH_2)_7CH_3$], as the aromatic compound, aromatic esters such as dibutyl phthalate[$C_6H_4(COOC_4H_9)_2$] and dioctyl phthalate[$C_6H_4(COOC_8H_{17})_2$] and as the aliphatic or aromatic mineral oils, process oils of paraffins and process oils of naphthenes may be mentioned.

In order to produce the porous sheet having minute and uniform pores, from 30 to 80 % by weight of a Component (B) are compounded with from 20 to 70 % by weight of a Component (A) and a film or sheet of a thickness or from 20 to 1000 μm is produced from the thus compounded materials by inflation molding, T-die sheet molding, press molding, etc. at a temperature of from 260° to 320° C. The plasticizer in the thus obtained sheet is removed from the sheet by extracting the plasticizer with a low-boiling solvent such as a lower alcohol (methanol, ethanol, propanol, etc.), a ketone(acetone, methyl ethyl ketone, etc.), a saturated aliphatic hydrocarbon(hexane, heptane, etc.) or a mixture thereof at a temperature of from 20° to 80° C. The thus treated sheet is then brought into drying to obtain the porous sheet having minute and uniform pores.

Then, the thus obtained porous sheet composed of the polymer of 3-methylbutene-1 is interposed between an aluminum plate of a thickness of from 0.5 to 3.0 mm and a copper foil of a thickness of from 10 to 40 μm, and the thus formed laminate is molded into a dielectric substrate having the two metal-clad surfaces for the planar antenna by an electrothermal press molding machine at a heat plate temperature of from 260 to 320° C under a pressure of 5 ~30 kg/cm2

Moreover, in order to improve the adhesion of the copper foil to the porous sheet and the surface properties of the copper foil, it is preferable to interpose a film of a maleic anhydride-modified polymer of 3-methylbutene-1 of a thickness of from 10 to 50 μm between the copper foil and the porous sheet.

In order to form a circuit of the microstrip element, dry film is laminated on a surface of the copper foil of the dielectric substrate and after exposing and developing, the circuit is formed by etching the copper foil with an aqueous solution of ferric chloride, thereby producing the planar antenna.

The planar antenna according to the present invention has a dielectric constant ($\epsilon$) of not higher than 2.2, preferably not higher than 2.0, more preferably not higher than 1.7, a dielectric loss tangent (tan $\delta$) of not higher than $15\times10^{-4}$, preferably not higher than $7\times10^{-4}$, more preferably not higher than $5\times10^{-4}$ and a gain of not less than 30 dB, preferably not less than 31.5 dB.

Still more, a planar antenna according to the present invention is excellent in high-frequency properties and thermal-resistance, and can be obtained at a low cost.

Accordingly, the planar antenna according to the present invention realizes a large contribution in the propagation thereof as a part of the receiving system of the satellite broadcasting in the future.

The planar antenna according to the present invention will be explained in detail while referring to Examples and Comparative Examples as follows.

At first, the materials used in Examples and Comparative Examples will be explained as follows.

(1) 3-Methylbutene-1(polymer A):

Copolymer of 3-methylbutene-1 and ethylene(95/5 by weight)

(2) 3-Methylbutene-1(polymer B):

Maleic anhydride-modified copolymer (the amount of grafting of 0.4 % by weight) of 88 % by weight of 3-methylbutene-1 and 12 % by weight of butene-1.

(3) 3-Methylbutene-1 (polymer C):

Blended material of copolymer of 3-methylbutene-1 and butene-1 (85/15 by weight) and a maleic anhydride-modified copolymer (the amount of grafting of 1 % by weight) of 90 % by weight of 3-methylbutene-1 and 10 % by weight of butene-1.

(4) 3-Methylbutene-1 (polymer D):

Mixture of 80 % by weight of the polymer A and 20 % by weight of a glass microbaloon (made by Nippon Silica Ind. Co., Ltd., Glass Microbaloon SI).

(5) Aluminum plate of a thickness of 2.0 mm:

In order to improve the adhesion, the binding surface thereof has been treated by anodic oxidation.

(6) Teflon film:

PFA film made by Mitsui Fluorochemical Co., Ltd.

(7) Teflon.glass fiber prepreg:,

CHEMFAB ® T.C.G.F No. 1008 made by Toppan Printing Co., Ltd.

(8) Adhesive film of epoxy resins:

Highsole Ox-072F made by Toray Co., Ltd.

(9) Cross-linked polyethylene sheet:

Sorijule ® made by Sorijule Japan Co., Ltd.

(10) Electrolytic copper foil:

Copper foil of a thickness of 35 μm made by Furukawa Mining Co., Ltd.

(11) Oxygen-free copper foil:

Oxygen Free Copper foil made by Hitachi Wire Co., Ltd.

The polymers A to D of 3-methylbutene-1 were used after improving the wettability thereof by treating thereof with corona discharge.

EXAMPLE 1

An electrolytic copper foil of 35 μm in thickness, a film of the polymer A of 3-methylbutene-1 of 800 μm in thickness and an aluminum plate of 2.0 mm in thickness were laminated in this order, and the thus formed laminate were molded into one body by heating at a hot plate temperature of 300° C. under a pressure of 40 kg/cm$^2$.

EXAMPLE 2

An oxygen-free copper foil of 35 μm in thickness, a film of the polymer B of 3-methylbutene-1 of 800 μm in thickness and an aluminum plate of 2.0 mm in thickness were laminated in this order, and the thus formed laminate were molded into one body by heating at a hot plate temperature of 300° C. under a pressure of 40 kg/cm$^2$.

EXAMPLE 3

An oxygen-free copper foil of 35 μm in thickness, a film of Teflon® of 50 μm in thickness, a film of the polymer C of 3-methylbutene-1 of 800 μm in thickness and an aluminum plate of 2.0 mm in thickness were laminated in this order, and the thus formed laminate were molded into one body by heating at a hot plate temperature of 350° C. under a pressure of 40 kg/cm$^2$.

EXAMPLE 4

An electrolytic copper foil of 35 μm in thickness, a film of Teflon® of 50 μm in thickness, a Teflon® glass cloth prepreg of 200 μm in thickness, a film of the polymer D of 3-methylbutene-1 of 600 μm in thickness and an aluminum plate of 2.0 mm in thickness were laminated in this order, and the thus formed laminate were molded into one body by heating at a hot plate temperature of 350° C. under a pressure of 40 kg/cm$^2$.

EXAMPLE 5

An oxygen-free copper foil of 35 μm in thickness, a film of the polymer A of 3-methylbutene-1 of 200 μm in thickness, a glass cloth of 100 μm in thickness, a film of the polymer A of 3-methylbutene-1 of 500 μm in thickness and an aluminum plate of 2.0 mm in thickness were laminated in this order, and the thus formed laminate were molded into one body by heating at a hot plate temperature of 300° C. under a pressure of 40 kg/cm$^2$.

EXAMPLE 6

An oxygen-free copper foil of 35 μm in thickness, a film of the polymer A of 3-methylbutene-1 of 200 μm in thickness, a glass cloth of 100 μm in thickness, a film of the polymer A of 3-methylbutene-1 of 500 μm in thickness, an oxygen-free copper foil of 35 μm in thickness, an adhesive film of epoxy resins of 50 μm in thickness and an aluminum plate of 2.0 mm in thickness were laminated in this order, and the thus formed laminate were molded into one body by heating at a hot plate temperature of 300° C. under a pressure of 40 kg/cm$^2$.

EXAMPLE 7

After adding a process oil of alkylbenzenes (AROMIX® 100P, made by NIPPON SEKIYUSENZAI Co., Ltd.) to the polymer B of 3-methylbutene-1, the composition shown in the postscript Table 2 was uniformly mixed by a Blabender mixer at 280° C. in a nitrogen atmosphere. By press-molding the thus obtained composition at a hot plate temperature of 280° C. under a pressure of 20 kg/cm$^2$, a sheet of 1000 μm in thickness was produced.

In the next place, the thus obtained sheet was treated for 20 min in ethanol at from 50° to 60° C. to extract AROMIX® from the sheet. By drying the thus treated sheet in a drier of a reduced pressure, a porous sheet of 800 μm in thickness was obtained.

An oxygen-free copper foil of 35 μm in thickness, a film of the polymer B of 3-methylbutene-1 of 30 μm in thickness, the thus obtained porous sheet of the polymer B of 3-methylbutene-1 of 800 μm in thickness and an aluminum plate of 2.0 mm in thickness were laminated in this order, and the thus formed laminate were molded into one body at a hot plate temperature of 280° C. under a pressure of 20 kg/cm$^2$.

COMPARATIVE EXAMPLE 1

An electrolytic copper foil of 35 μm in thickness, a sheet of cross-linked polyethylene of 800 μm in thickness and an aluminum plate of 2.0 mm in thickness were laminated in this order, and the thus formed laminate were molded into one body by heating thereof at a hot plate temperature of 350° C. under a pressure of 40 kg/cm$^2$.

COMPARATIVE EXAMPLE 2

An electrolytic copper foil of 35 μm in thickness, a film of Teflon® of 50 μm in thickness, four pieces of Teflon® cloth prepreg of each 200 μm in thickness, a film of Teflon® of 50 μm in thickness and an aluminum plate of 2.0 mm in thickness were laminated in this order, and the thus formed laminate were molded into one body by heating thereof at a hot plate temperature of 350° C. under a pressure of 40 kg/cm$^2$.

In order to evaluate the specific properties of the dielectric substrates having the two metal-clad surfaces and the performance of the planar antenna, which had obtained in Examples and Comparative Examples, the copper foil was subjected to etching for forming the strip line and the dielectric constant (ε), the dielectric loss tangent (tan δ) and the gain were measured at a frequency of 12 GHz($12\times10^9$ Hz). The results of the measurement are shown in Tables 1 and 2.

TABLE 1

| | Size of Antenna: 450 × 450 mm | | | |
|---|---|---|---|---|
| | Dielectric specificities | | | |
| | Dielectric constant | Dielectric loss tangent ($\times 10^{-4}$) | Gain (dB) | Durability*1 (cycle) |
| Example 1 | 2.1 | 10 | 30 | 20 |
| Example 2 | 2.1 | 10 | 31 | 25 |
| Example 3 | 2.1 | 10 | 31 | 25 |
| Example 4 | 2.2 | 12 | 30 | >30 |
| Example 5 | 2.2 | 15 | 30 | >30 |
| Example 6 | 2.2 | 12 | 30.5 | >30 |
| Comparative Example 1 | 2.3 | 20 | 28 | >30 |

TABLE 1-continued

| | Size of Antenna: 450 × 450 mm | | | |
|---|---|---|---|---|
| | Dielectric specificities | | | |
| | Dielectric constant | Dielectric loss tangent (× $10^{-4}$) | Gain (dB) | Durability*1 (cycle) |
| Comparative Example 2 | 2.6 | 22 | 28 | >30 |

Note:
*1Durability: Heat cycle test was carried out under the conditions of from −40° C. × 1 hour to 125° C. × 1 hour, to evaluate the adhesion between the aluminum plate or the copper foil and dielectric layer, and the warp thereof.

TABLE 2

| Compounding composition of material | | Size of Antenna: 450 × 450 mm | | | | |
|---|---|---|---|---|---|---|
| | | | Dielectric specificities | | | |
| Polymer (B) of 3-methylbutene-1 | AROMIX 100 p | Expansion ratio | Dielectric constant | Dielectric loss tangent (× $10^{-4}$) | Gain (dB) | Durability (cycle) |
| 70 | 30 | 1.2 | 2.0 | 7 | 31.5 | >30 |
| 50 | 50 | 1.5 | 1.7 | 5 | 32 | >30 |
| 20 | 80 | 2.0 | 1.6 | <5 | 32 | >30 |

As are seen in Table 1, the planar antennas obtained in Examples 1 to 6 are low in the dielectric constant and the dielectric loss tangent as compared to the conventional planar antenna, and at the same time, are excellent in the dimensional stability and the heat-resistance, and they can be obtained at a low cost, therefore they are excellent as the planar antenna.

Concerning the difference of the gain between the electrolytic copper foil and the oxygen-free copper foil, the oxygen-free copper foil was better than the electrolytic copper foil by 1 dB.

Besides, by taking the construction of the planar antenna of Example 6, because the radio waves can be radiated from the surface of the oxygen-free copper foil which situates in the middle and is relatively smooth,not from the aluminum plate which has been made to be rough of the planar antenna of Example 5, the gain of the planar antenna of Example 6 was higher by about 0.5 dB than that of the planar antenna of Example 5.

Still more, as a result of the comparison of Example 7 with Example 2, it was found that the planar antenna having the porous dielectric layer was excellent in the durability and the gain,and had a high performance.

What is claimed is:

1. A planar antenna comprising a porous dielectric layer comprising at least one polymer selected from the group consisting of a 3-methylbutene-1homopolymer, a copolymer of 3-methylbutene-1 and an α-olefin having from 2 to 12 carbon atoms, a copolymer of 3-methylbutene-1and a polyene, a copolymer of 3-methylbutene-1, said α-olefin and said polyene, and a modified polymer obtained by graft-polymerizing a radically polymerizable monomer to each of said homopolymer and said copolymers; a conductor on one of the surfaces of said dielectric layer; and a circularly polarized radiation microstrip element on the other surface of said dielectric layer which is formed from a metal foil; said porous dielectric layer being produced by molding a mixture comprising 20 to 70% by weight of at least one polymer selected from the group consisting of said homopolymer, said copolymers and said modified polymer and 30 to 80% by weight of at least one plasticizer selected from the group consisting of an aliphatic compound, an aromatic compound, an aliphatic mineral oil and an aromatic mineral oil at a temperature of from 260° to 320° C. into a sheet form, and then subjecting the sheet to extraction with a low-boiling solvent.

2. A planar antenna according to claim 1, wherein the thickness of said dielectric layer is from 500 to 1000 μm, the thickness of said conductor is from 0.5 to 3.0 mm and the thickness of said metal foil which forms said circularly polarized radiation microstrip element is from 10 to 40 μm.

3. A planar antenna according to claim 1, which has dielectric constant (ε) of not higher than 2.2, dielectric loss tangent (tan δ) of not higher than $15\times10^{-4}$ and gain of not less than 30 dB.

4. A planar antenna according to claim 1, wherein a glass cloth has been laminated on said dielectric layer.

5. A planar antenna according to claim 1, wherein the porosity of said dielectric layer is not less than 1.2 times as calculated by expansion ratio.

6. A planar antenna according to claim 1, wherein said aliphatic compound is cetyl alcohol, heptadecyl alcohol, stearyl alcohol, ceryl alcohol, behenyl alcohol, dioctyl ether, didecyl ether, didodecyl ether, diotadecyl ether, methyl tetradecyul ketone, n-propyl hexadecyl ketone, didodecyl ketone, dioctadecyl ketone, octyl laurate, ethyl palmitate, butyl stearate or octyl stearate.

7. A planar antenna according to claim 1, wherein said aromatic compound is dibutyl phthalate or dioctyl phthalate.

8. A planar antenna according to claim 1, wherein said aliphatic mineral oil is a process oil of paraffins.

9. A planar antenna according to claim 1, wherein said aromatic mineral oil is a process oil of naphthenes.

10. A planar antenna according to claim 1, wherein said low-boiling solvent is a lower alcohol, a ketone, a saturated aliphatic hydrocarbon or a mixture thereof.

11. A planar antenna according to claim 10, wherein said lower alcohol is methanol, ethanol or propanol.

12. A planar antenna according to claim 10, wherein said ketone is acetone or methyl ethyl ketone.

13. A planar antenna according to claim 10, wherein said saturated aliphatic hydrocarbon is hexane or heptane.

14. A planar antenna according to claim 1, wherein said radically polymerizable monomer is an unsaturated monocarboxylic acid, an ester thereof, an unsaturated dicarboxylic acid, an anhydride thereof, an amide thereof, a cycloaliphatic polybase carboxylic acid having an unsaturated bond, an aromatic vinyl compound or a vinyl ester.

15. A planar antenna according to claim 14, wherein said radically polymerizable monomer is a member selected from the group consisting of acrylic acid, glycidyl acrylate, maleic acid, maleic anhydride, maleamide, styrene, α-methylstyrene and vinyl acetate.

* * * * *

UNITED STATES PATENT AND TRADEMARK OFFICE

CERTIFICATE OF CORRECTION

PATENT NO. : 4,963,891

DATED : October 16, 1990

INVENTOR(S) : AOYAGI ET AL

It is certified that error appears in the above-identified patent and that said Letters Patent is hereby corrected as shown below:

On the title page, at [73], delete "Assignee" and insert --Assignees--;

After "Tokyo, Japan" the second Assignee should be added as follows: --Sumitomo Bakelite Company, Limited Tokyo, Japan--.

Signed and Sealed this

Nineteenth Day of May, 1992

*Attest:*

DOUGLAS B. COMER

*Attesting Officer*

*Acting Commissioner of Patents and Trademarks*